United States Patent [19]

Hodges

[11] Patent Number: 4,574,978

[45] Date of Patent: Mar. 11, 1986

[54] BEVERAGE CONTAINER CARRIER

[76] Inventor: Jeffrey M. Hodges, 1215 Beach Dr., Lake Orion, Mich. 48035

[21] Appl. No.: 624,730

[22] Filed: Jun. 26, 1984

[51] Int. Cl.[4] ..... B65D 25/16

[52] U.S. Cl. ..... 220/403; 206/427; 220/404

[58] Field of Search ..... 220/403, 404; 206/427

[56] References Cited

U.S. PATENT DOCUMENTS

| | | | |
|---|---|---|---|
| 2,226,340 | 12/1940 | Flood | 220/403 |
| 3,043,489 | 7/1962 | Anderson | 220/403 |
| 3,185,339 | 5/1965 | Fleming | 220/403 |
| 3,310,265 | 3/1967 | Mulloy | 220/404 |
| 3,484,017 | 12/1969 | O'Donnell | 220/403 |
| 3,502,238 | 3/1970 | Kelly | 220/404 |
| 3,861,504 | 1/1975 | McGraw | 220/403 |
| 4,290,525 | 9/1981 | Sisson | 206/427 |
| 4,300,697 | 11/1981 | Dickens | 220/19 |

*Primary Examiner*—George E. Lowrance

*Attorney, Agent, or Firm*—Gifford, Groh, VanOphem, Sheridan, Sprinkle & Dolgorukov

[57] ABSTRACT

A device for transporting a plurality of similarly sized beverage cans includes a transparent, flexible pouch of fixed dimensions, and a rigid housing in which the pouch is slidably received. The front and rear walls of the pouch and housing are spaced apart a distance about equal to the length of the cans, so that when the cans are inserted with their ends adjacent the front and rear walls, they will remain in unidirectional alignment upon removal of the pouch from the housing. The pouch includes a flap for keeping the cans in the pouch, and adhesive tape for securing the flap to the front of the pouch. The tape passes through a facial opening in the housing in order to seal the pouch while it is in the housing. The pouch is preferably transparent so that the number of cans can be accurately counted, and so that it can be visually confirmed that all of the cans are of the type returnable for a refund of any deposit. In one preferred embodiment the housing and pouch walls serve as the sole means for maintaining alignment of the cans.

6 Claims, 2 Drawing Figures

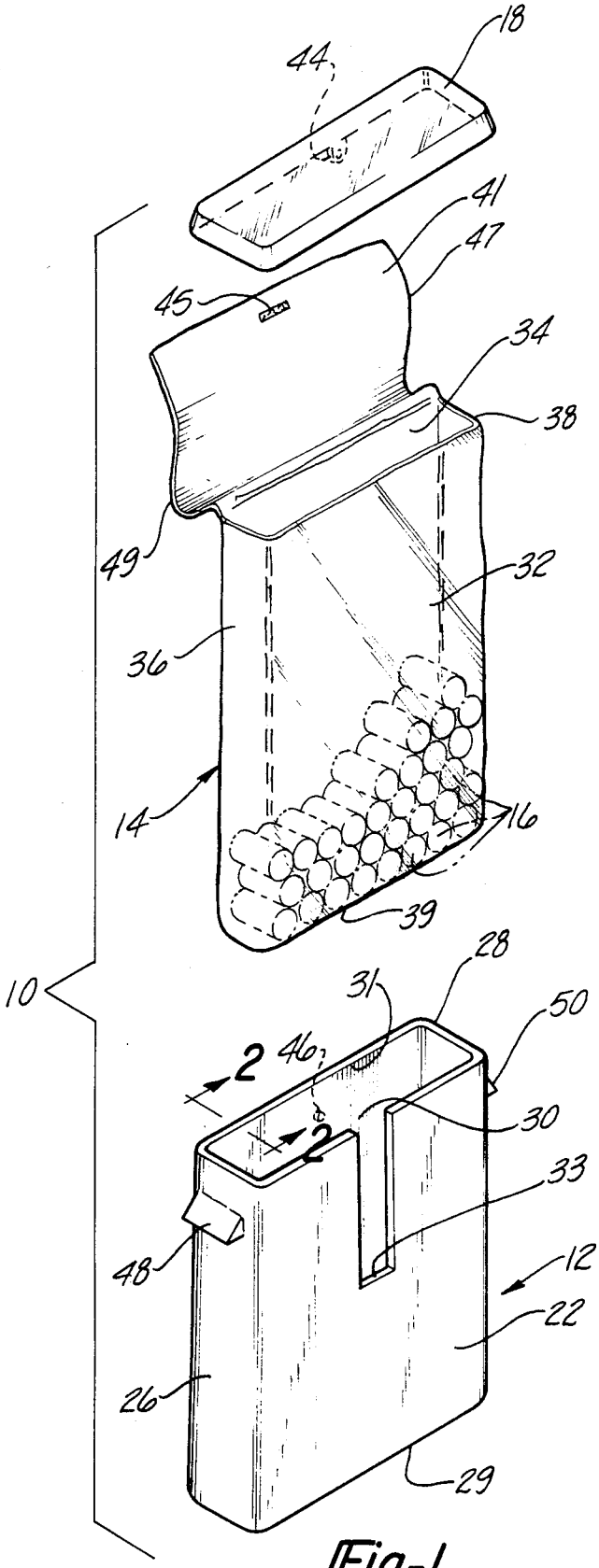
Fig-1
Fig-2
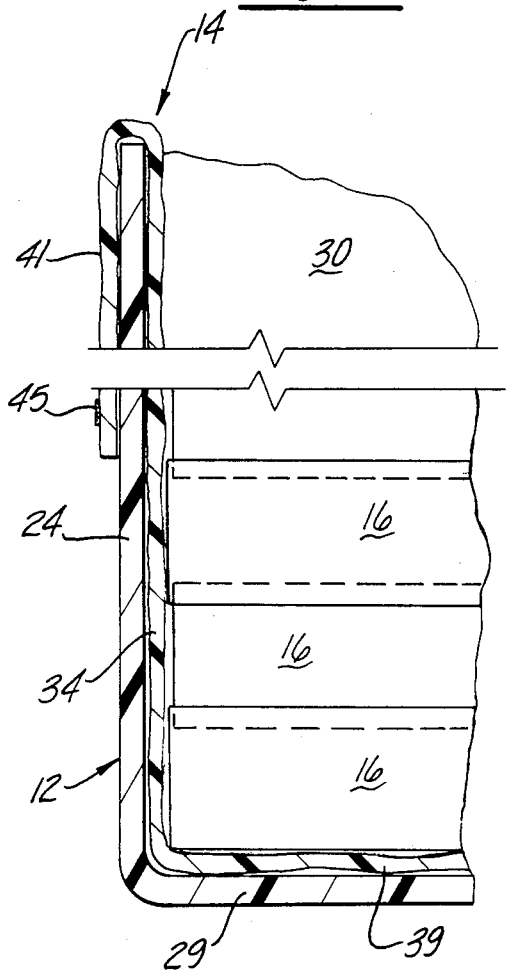

BEVERAGE CONTAINER CARRIER

BACKGROUND OF THE INVENTION

I. Field of the Invention

The present invention relates generally to beverage container carriers and more specifically to such a container having a transparent walled liner which is easily inserted and extracted from the carrier.

II. Description of the Prior Art

Beverages are often sold in returnable containers for which a deposit is paid and the containers must be returned to the retail outlet after use so that the deposit can be returned. The accumulation, storage and transporting of these containers by the consumer is often troublesome and inconvenient. This is especially true where, as in the State of Michigan, state law requires that beverages be sold in returnable containers.

One previously known device for making the return of such containers more convenient is the carton in which such beverage containers are sold at retail. These cartons generally have a predetermined number of compartments into which individual containers can be placed. Since the containers must often be sorted according to brand by the retail merchant who receives the returned containers, and since the merchant must check the containers to determine that they are of the type for which a deposit has been paid and should be returned, the cartons are designed so that each individual container must be exposed to be viewed from the outside. In addition, since each such carrier carton must be handled separately and the number of beverage containers that can be carried in such containers is strictly limited, the return of a large number of returnable beverage containers is quite cumbersome.

Moreover, these previously known containers are made of a relatively undurable material and are thus quite subject to deterioration or damage due to the leakage from the beverage containers. In addition, after repeated usage, these cartons become flimsy and become useless as a container carrier and therefore must be replaced with a new carrier. Moreover, they do not prevent any residue remaining in the beverage can after the contents have been consumed from leaking out of the container and soiling or straining the carton or surrounding articles. Thus, the use of these cartons can be untidy as well as impractical.

SUMMARY OF THE PRESENT INVENTION

The present invention overcomes the above mentioned disadvantages by providing a rigid-walled, open-topped container which is appropriately sized to receive an orderly accumulation of beverage containers. The container includes a lining which is easily insertable in and removable from the rigid-walled container and which provides a clear view of the beverage containers when the lining is removed from the rigid-walled container. In addition, the beverage containers remain orderly arranged within the liner when the liner is removed from the rigid-walled container. Preferably the liner is made of relatively inexpensive material so that it is conveniently disposed of when soiled by the residue remaining in the beverage containers.

BRIEF DESCRIPTION OF THE DRAWING

The present invention will be more clearly understood by reference to the following detailed description in conjunction with the accompanying drawing wherein like reference characters refer to like parts in both views and wherein:

FIG. 1 is an exploded perspective view of the beverage container carrier of the present invention.

FIG. 2 is a fragmentary sectional elevation of the carrier shown in FIG. 1.

DETAILED DESCRIPTION OF THE PRESENT INVENTION

Referring now to FIG. 1, the carrier 10 of the present invention is thereshown comprising a rigid, open-topped container 12 and a flexible liner 14 appropriately dimensioned to be slidably inserted within the container 12. A plurality of beverage containers 16 are laid side by side within the liner 14 to create a plurality of rows of beverage containers 16. In the preferred embodiment of the present invention as shown in FIG. 1, a removable cover 18 fits over the top of the container 12 so that the open top of the container 12 can be closed during transportation of the container.

As best shown in FIG. 1, the container 12 includes a front wall 22, a back wall 24, two opposed side walls 26 and 28, and a bottom wall 29. These walls define an open-topped chamber 30 within the container 12 which is appropriately sized to slidably receive the liner 14, which will be discussed in detail hereinafter. Moreover, the front wall 22 also comprises a narrow facial opening 33 which extends from the top opening 31 partially down the front wall 22. The facial opening 33 and the liner 14 will be discussed in detail hereinafter. Preferably the walls 22, 24, 26, 28 and 29 are made of a lightweight and rigid plastic. The container 12 is provided with a pair of handles 48 and 50 secured at the upper end of the side walls 26 and 28 respectively. Of course, the particular type and position of the handles can be changed without departing from the scope of the present invention.

The top 18 illustrated in the preferred embodiment of the present invention is secured by frictional engagement with the uppermost portion of walls 22, 24, 26, and 28. Nevertheless, it is to be understood that the cover 18 can be provided with an additional locking means, if desired, to secure the cover in its closed position over the open top 31 of chamber 30, such as the apertured tab 44 which engages the projecting pin 46 on the outer surface of the back wall 24.

The liner 14 has a front wall 32, a back wall 34, a pair of side walls 36 and 38, a bottom wall 39, and a top flat 41. The side walls 36 and 38 and the bottom wall 39 have a width substantially equal to the height of the beverage containers 16. As shown in FIG. 1, the beverage containers 16 are twelve ounce beverage cans which are typically provided in a standard size regardless of the brand or type of beverage contained within the can. Consequently, the length of the bottom wall 39, the width of the front wall 32 and the width of the back wall 34 are preferably substantially equal to an integral multiple of the diameter of a standard twelve ounce beverage can. The height of the walls 32, 34, 36 and 38 of the pouch 14 is also substantially equal to an integral multiple of the diameter of a standard twelve ounce beverage can although in the preferred embodiment the height is greater than the width for ease of transport. Thus, the top of the walls of the pouch 14 substantially align with the top of the rigid container 12.

The pouch 14 is also provided with a top flap 41 designed to cover the top opening of the pouch 14 during storage. Securing means 45 are provided whereby the top flap 41 may be attached to the front wall 32 of the pouch 14 through the facial opening 33 of the container 12. In the preferred embodiment the securing means 45 comprises a strip of reusable adhesive such that the top flap 41 is easily removable from the front wall 32 each time the user wishes to place a beverage container 16 within the pouch 14. Moreover, once the carrier 10 is filled with beverage containers 16 and the top flat 41 is secured to the front wall 32, the pouch 14 may be easily removed from the rigid container by grasping the top flap 41 along its side edges 47 and 49.

At least one of the walls 32 and 34 is transparent so that the markings that appear on beverage cans to indicate that the cans are returnable can be viewed from the exterior of the lining 14. However, as shown in the illustration of the preferred embodiment in FIG. 1, the walls of the liner 14 are integrally formed of a transparent material. The advantages of such a construction will become readily appearent from the discussion of the operation of the device of the present invention which follows.

Having thus described the important structural features of the preferred embodiment of the present invention illustrated in FIG. 1, the operation of the device can be described. The liner 14 is stored within the chamber 30 of the container 12 so that the open top of the liner 14 registers with the open top of the chamber 30. Thus, the walls 32, 34, 36, 38 and 39 of the liner 14 lie adjacent to the walls 22, 24, 26, 28 and 29, respectively, as partially illustrated in FIG. 2. The top flap 41 is folded over the uppermost outer surface of the back wall 24 of the container 12 so that the open top of the liner registers with the top 31 of chamber 30 and remains fully open. The cans or containers 16 are then inserted and stacked within the liner 14 by placing them on their side so that the top and bottom of the cans lie adjacent to the walls 32 and 34 of the liner. Since the liner is appropriately sized to correspond with the size of the containers inserted therein, a large number of cans can be inserted within the carrier and stored in a compact and efficient arrangement. Moreover, since the empty beverage cans are relatively light, the carrier can be made relatively large so that a large number of cans can be stored within the carrier without making the carrier too heavy or cumbersome to transport when fully loaded. Therefore, lifting and transporting the used beverage containers is not difficult.

When the carrier has been filled, the top flap 41 is closed over the top of the pouch 14 and secured by way of securing means 45, to the front wall 32 of the pouch 14 through the facial opening 33 of the rigid container 12 and the cover 18 can be closed over the open top of the chamber 30 to further prevent the cans from falling out during transportation of the carrier. The carrier is easily grasped by the handles 48 and 50 and carried to retail outlets for return of the containers. After arriving at the return center, the cover is removed and edges 47 and 49 of the flap 41 are easily grasped in order to pull the liner 14 from the container 12. Even though the flexible liner is removed from the rigid container, the cans remain stacked in an orderly arrangement. Therefore, since the tops and bottoms of the cans are easily viewed through the walls of the liner, the retailer can readily determine whether all of the cans in the container are of the returnable type and the amount of the deposit which must be returned is easily calculated.

The liner is preferably made of inexpensive, lightweight material so that it is disposable. Therefore, the liner can be left with the retailer merchant so that the cans need not be restacked in another container but remain in a compact and orderly arrangement. Alternatively, the cans can be emptied from the liner and the liner returned to the chamber 30 of the container 12. Nevertheless, when the liner has become soiled from the residue which spills from the used beverage containers, it can be conveniently discarded and replaced with a new, clean liner 14. Thus, the present invention provides a carrier which provides clean and compact storage of used beverage containers as well as a carrier which is easily transportable to carry a large number of used beverage containers and which furthermore provides for quick and easy inspection of the beverage containers being returned.

Having thus described my invention many modifications thereto will become apparent to those skilled in the art to which it pertains without departing from the scope or spirit of the present invention as defined in the appended claims.

I claim:

1. A beverage container carrier for transporting a plurality of similarly sized beverage containers each having a pair of opposing and generally flat ends, said carrier comprising:

a flexible open-topped pouch having a front wall, a back wall, two opposed side walls and a bottom wall, all of said walls having substantially fixed dimensions; a flap secured to said rear wall; and means for securing said flap over the top of said pouch and to said front wall of said pouch; and a rigid-walled, open-topped housing dimensioned to slideably receive said pouch therein; said housing including a face adjacent said front wall of said pouch and an opening therethrough extending partially down said face and having a width less than that of said face, said securing means being operable through said opening;

wherein said front wall and said back wall are spaced apart by said side walls and said bottom wall a distance substantially equal to the length of said beverage container and said side walls being spaced apart by said front wall and said back wall a distance substantially equal to an integral multiple of the diameter of said beverage containers, so that containers stacked on their sides in said pouch remain aligned in a uniform arrangement upon removal of said pouch from said housing.

2. The invention as defined in claim 1 and further comprising a handle on said housing.

3. The invention as defined in claim 1 wherein the height of said housing is substantially equal to an integral multiple of the diameter of said beverage containers.

4. The invention as defined in claim 1 wherein said pouch is transparent.

5. The invention as defined in claim 1 and further comprising a cover dimensioned to frictionally engage the upper portion of said housing and close said housing.

6. The invention as defined in claim 1, wherein said securing means comprises an adhesive strip disposed on one of said front pouch wall and said flap, which is engageable with the other of said flap and said front pouch wall.

* * * * *